US005916108A

United States Patent [19]

Drietz et al.

[11] Patent Number: 5,916,108

[45] Date of Patent: Jun. 29, 1999

[54] DEVICE AND METHOD FOR APPLYING A TIE RIBBON TO AN ARITCLE

[75] Inventors: Stan W. Drietz, Worthington; James A. Beckman, Reading, both of Minn.

[73] Assignee: Bedford Industries, Inc., Worthington, Minn.

[21] Appl. No.: 08/853,028

[22] Filed: May 8, 1997

[51] Int. Cl.[6] ..... B65B 7/12

[52] U.S. Cl. ..... 53/370; 53/137.2; 53/589

[58] Field of Search ..... 53/138.8, 137.2, 53/414, 589, 370; 100/31, 26, 4

[56] References Cited

U.S. PATENT DOCUMENTS

| | | | |
|---|---|---|---|
| 3,261,143 | 7/1966 | Platt | 53/138.8 |
| 3,318,230 | 5/1967 | Hilton | 100/4 |
| 3,428,096 | 2/1969 | Krylov et al. | 140/93.6 |
| 3,898,924 | 8/1975 | Mead et al. | 100/12 |
| 4,177,842 | 12/1979 | Dilley | 140/93.6 |
| 4,559,977 | 12/1985 | Dilley | 140/93.6 |
| 4,655,264 | 4/1987 | Dilley | 140/93.6 |
| 5,121,682 | 6/1992 | Parker et al. | 53/138.8 |
| 5,389,190 | 2/1995 | Larsen et al. | 156/521 |
| 5,390,473 | 2/1995 | Nelson et al. | 53/417 |
| 5,402,619 | 4/1995 | Nelson et al. | 53/76 |
| 5,465,549 | 11/1995 | Lummus | 53/138.8 |

*Primary Examiner*—Jessica J. Harrison
*Assistant Examiner*—John Paradiso
*Attorney, Agent, or Firm*—Kinney & Lange, P.A.

[57] ABSTRACT

An apparatus and method for fastening a tie fastener about an article is disclosed. The apparatus includes an optic sensing mechanism, a magnetic attracting mechanism, and an automatic control system. The optic sensing mechanism facilitates control over advancement and retraction of the tie fastener within the apparatus while the automatic control system controls all functions of the apparatus. The magnetic attracting mechanism facilitates manipulation of the tie fastener material adjacent the article.

17 Claims, 11 Drawing Sheets

16
145
144
146
149
148
24
130
136
48
166
156
152
150
151
160
162
164
46
26
140
131
132A
134A
133
141
137
170
194
195
186
154
30
199B
180
42
118
40
22
190
110
122
34
44
112
32
188
120
114
100
14
104
102
106
76
83
64
68
86
70
66
85
A
20
74
18
60
62
78
C
80
B
82

DEVICE AND METHOD FOR APPLYING A TIE RIBBON TO AN ARITCLE

BACKGROUND OF THE INVENTION

The present invention generally relates to twist-tie ribbons and in particular relates to a machine for applying a twist-tie ribbon to an article.

A twist-tie ribbon fastener is typically secured about an article by encircling the article with the tie ribbon and then twisting the ends of the twist-tie about each other to tighten the twist-tie into secure engagement about the article. Various devices have been proposed for applying a twist-tie to an article to securely fasten the twist-tie about the article.

One type of known device employs a ring for positioning a twist-tie ribbon about an article to encircle the article and has a gripping and twisting means that holds the ends of the twist-tie in close proximity to each other and then twists the ends of the tie ribbon about each other. A positioning means maneuvers the twist-tie ribbon along the ring and into engagement with the gripping and twisting means. The twisting and gripping means of these devices include a twister head that is rotatable about its axis to twist the ends of the ties about each other. A pair of push rods extend within the gripping/twisting means head and selectively traps the ends of the twist-tie against a portion of the head. In these devices, sliding extension and retraction of the push rods is controlled either by a rack and pinion system in combination with a rotating cam or by an air cylinder system which causes a complex of linkages to cause the push rods to be extended or retracted. Examples of these prior devices are found in Dilley U.S. Pat. No. 4,177,842, Mead et. al. U.S. Pat. No. 3,898,924, Hilton U.S. Pat. No. 3,318,230.

In a modification of these known devices, a twisting/gripping means includes a hook system which pulls the twist-tie against the head to grip the ends of the twist-tie (instead of trapping the tie ribbon by pushing an end of the tie ribbon against a portion of the head). For example, see Dilley U.S. Pat. Nos. 4,559,977 and 4,655,264.

In these prior devices, the timing and sequence of positioning a twist-tie about an article, gripping the ends of the twist-tie, and twisting the ends of the tie about each other are typically controlled by the relative dimensions, curved shapes, and positioning of a rotating cam or by the shapes and dimensions of a complex linkage system. For example, these prior devices have several linkages, which move in varying directions, to accomplish simple linear movement of a push rod for gripping a twist-tie end. In addition, the varying shape of the outer surface of the rotating cam causes the speed of movement of the tie ribbon to vary, which causes some slippage of the tie ribbon relative to the driving rollers of the device. These mechanical linkages and cam systems make it difficult to adjust the timing and sequence of functions of the devices since any significant changes in timing or sequence would require replacing a cam or linkage system. This inability to readily adjust operation of these devices limits their uses to a narrow set of applications.

SUMMARY OF THE INVENTION

A device of the present invention fastens a twist-tie about an article and comprises a guiding ring, means for moving the twist-tie about the ring, and a detecting means. The ring is configured and arranged to receive and guide sliding movement of the tie fastener about an article within the ring. The moving means moves the twist-tie along an inner surface of the ring so that the tie fastener encircles the article. The detecting means detects a first end of tie fastener traveling past the detecting means and is located along the ring and exposed to the travel path of the tie fastener. Upon the detecting means detecting the first end of the tie fastener, the moving means is selectively actuated after a predetermined time delay to stop movement of the tie fastener along the inner surface of the ring to permit further manipulation of the tie fastener relative to the article. The detecting means permits precision stopping and starting of drive rollers which control advancement of the tie ribbon, thereby eliminating or substantially reducing slippage of the tie ribbon relative to the drive rollers. Moreover, the amount of predetermined delay is adjustable to permit timing for special applications.

The tie fastener also preferably includes a metallic portion and the ring further comprises means for magnetically attracting and holding the tie fastener against the inner surface of the ring as the tie fastener moves along the inner surface of the ring. The magnetic holding means insures that the tie ribbon is maintained against the inner surface of the guiding ring at two important locations. First, an upper portion of the magnetic holding means insures that the tie ribbon tracks the guiding ring as the tie ribbon first enters the guiding ring. Second, a lower portion of the magnetic holding means insures that the tie ribbon tracks the guiding ring just prior to the tie ribbon re-entering a twisting/gripping means.

The device of the present invention also further comprises means for automatically and selectively controlling a continuous sequence of activation and deactivation of an extracting means, the moving means, the gripping means and twisting means, and cutting means to position the twist-tie about the article and twist the tie tightly about the article. In addition, this automatic and selective control means is capable of selectively interrupting the continuous sequence of activating and deactivating the moving means, cutting means, gripping means and twisting means to permit the activation and deactivation of each of the moving means, cutting means, gripping means and twisting means in isolation relative to each of the other means. These automatic control and isolation features significantly improve troubleshooting and adjustment of each of the functions of the device and permits selective adaptation of individual functions for specialized applications.

The twisting and gripping means preferably further comprises a pair of elongate push rods, a coupler, and a pneumatic air cylinder system. Each elongate push rod has a first end and a second end and is arranged relative to the ring so that the first end is adjacent the tie ribbon travel path of the ring for gripping an end of the tie ribbon and is capable of sliding movement towards and away from the tie ribbon. The coupler has a first end and a second end and a generally cylindrical shape with the first end of the coupler connected to the second end of each push rod. The coupler is capable of selective sliding movement along a path generally parallel to a longitudinal axis of each push rod. An air pressure cylinder and rod system includes an extendable rod directly connected to the second end of the coupler so that selective sliding movement of a push rod relative to the cylinder causes sliding movement of the coupler and of the push rod. The extendable rod is generally parallel to a longitudinal axis of the push rod and coupler. This air cylinder/rod system permits direct and highly controllable gripping of a tie ribbon.

Independently, each of these functions and features enables a more precise and more controllable manipulation of a tie ribbon. In combination, these functions and features enable smooth, predictable high speed application of tie ribbons about an article and enable quick step-by-step troubleshooting to insure accurate and easy adjustment for each function.

DETAILED DESCRIPTION OF THE PREFERRED EMBODIMENTS

Figure 1:
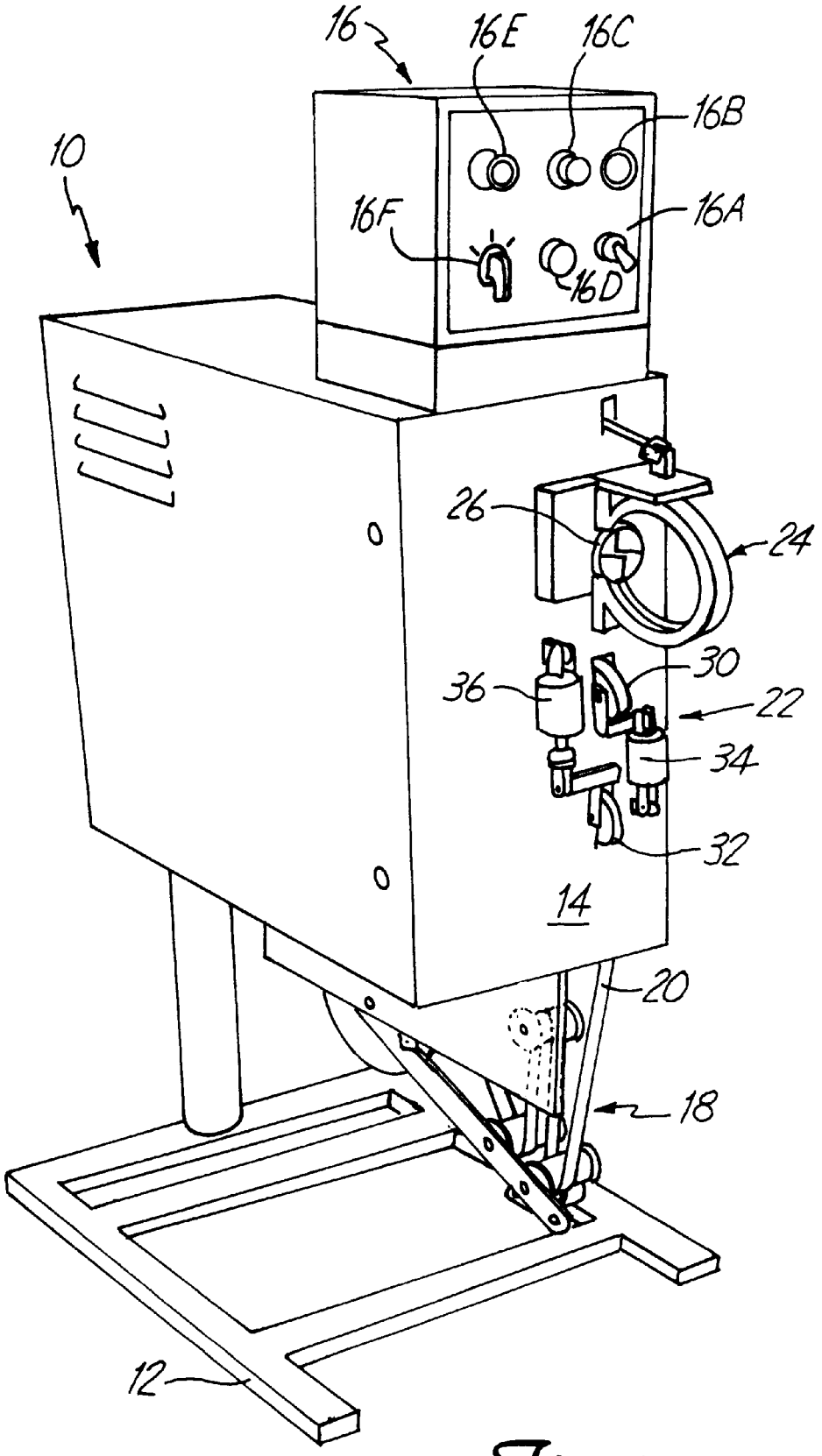
FIG. 1 is a perspective view of a twist-tie applicator of the present invention.

The twist-tie tying device of the present invention is illustrated generally in FIG. 1 at 10. Device 10 includes base 12, housing 14, control system 16, and tie ribbon supply system 18, which includes tie ribbon 20. Device 10 further includes tie ribbon manipulation system 22, guide ring system 24, and twister/gripper head 26. Finally, tie manipulation system 22 includes, in part, primary feed roller 30 and secondary feed roller 32, primary feed roller air cylinder 34, and secondary feed roller air cylinder 36. Control system 16 includes power switch 16A, power indicator 16B, emergency stop button 16C, reset button 16D, manual cut button 16E, and mode control 16F.

Figure 2:
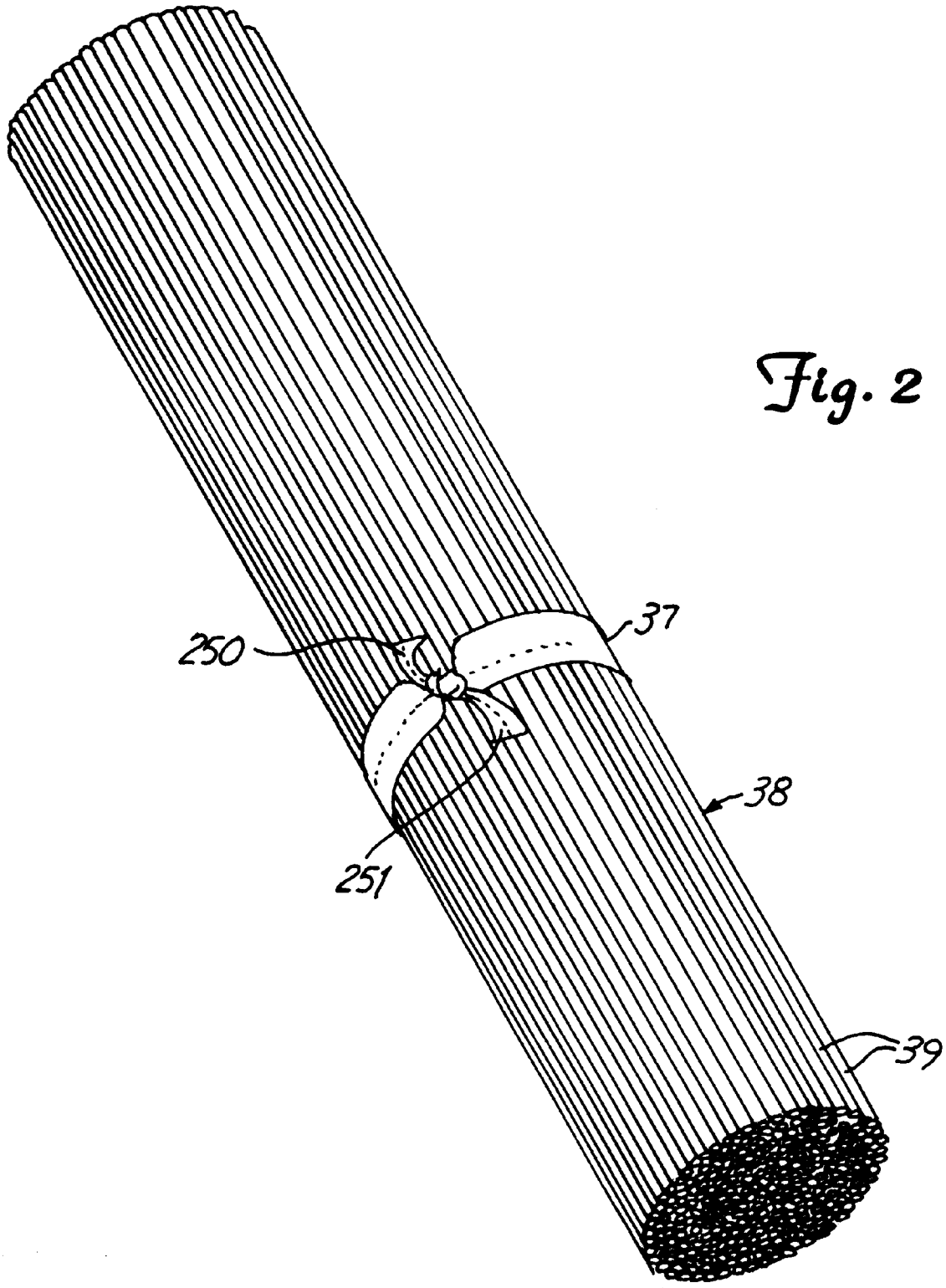
FIG. 2 is a perspective view of an article with a twist-tie securely fastened about the article.

Device 10 is used to secure a portion of tie ribbon 20 about an article. Tie manipulation system 22 removes tie ribbon 20 from tie supply system 18 and moves tie ribbon 20 through twister/gripper head 26 for passage through guide ring system 24 so that tie ribbon 20 encircles an article extending through the guide ring system 24. After tie ribbon 20 is cut by tie manipulation system 22, the ends of a portion of tie ribbon 20 encircling the article are gripped by twister/gripper head 26 and head 26 rotates causing the gripped ends of the cut tie ribbon portion to be twisted about each other. This twisting of the ends of tie ribbon 20 securely fastens the cut portion of tie ribbon 20 about the article. The result is shown in FIG. 2 in which a twist-tie 37, i.e., a cut portion of tie ribbon 20, is securely fastened about an article 38. Article 38 is typically a plurality of elements 39 held together by twist-tie 37. Twist-tie 37 includes free ends 250 and 251. The structure of the systems further comprising device 10 will be described in further detail in context with their respective functions.

A. System Overview

Figure 3:
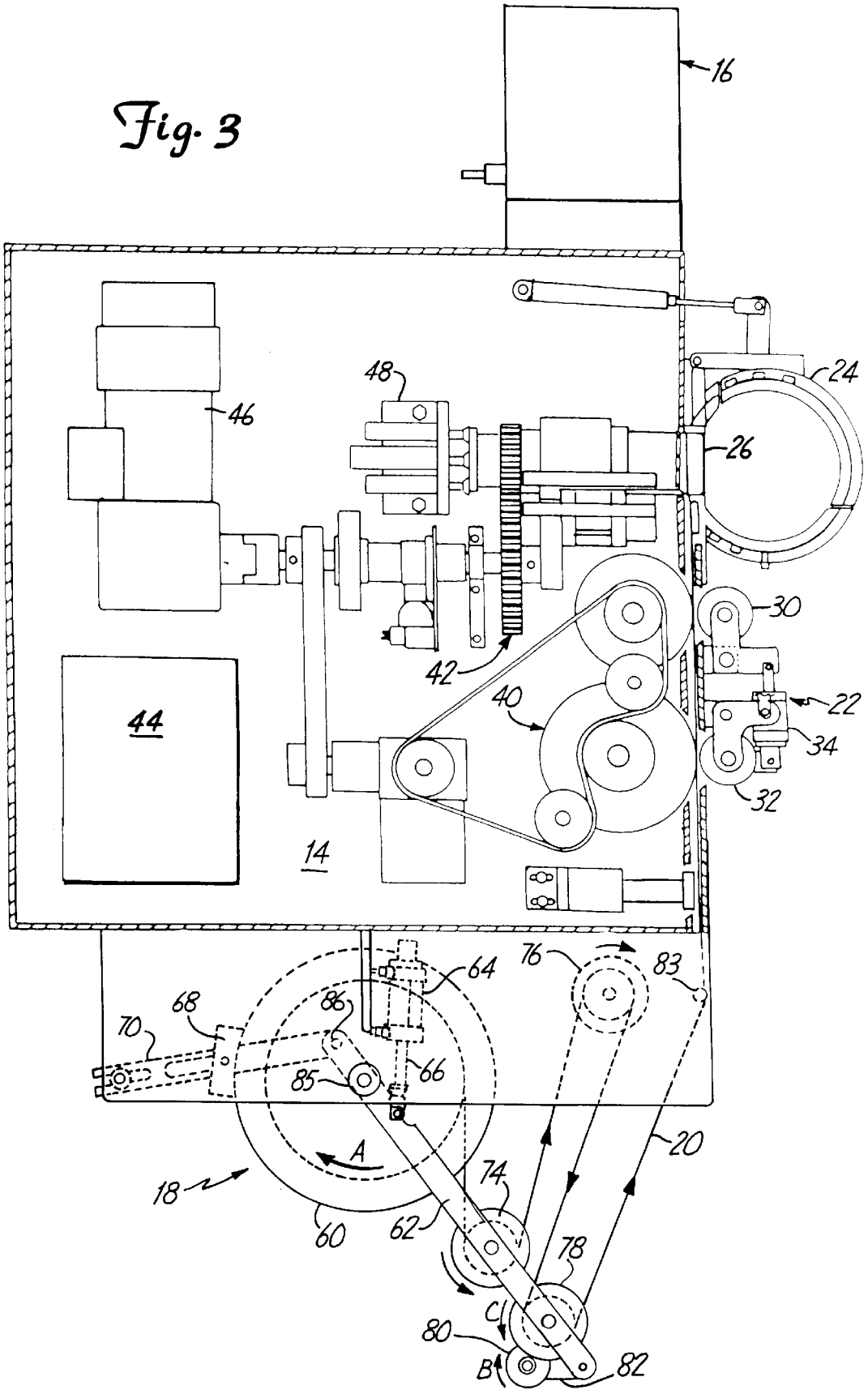
FIG. 3 is a sectional side view of the twist-tie applicator of FIG. 1.

FIG. 3 is a sectional view of device housing 14 including a side view of the tie ribbon supply system 18. As shown in FIG. 3, the tie manipulation system 22 further includes drive roller system 40, gear system 42, PLC 44, motor 46, and air cylinder system 48. Each of these components will be described in further detail in the remainder of the detailed description. The drive roller system 40 operates in cooperation with feed rollers 30 and 32 of the tie manipulation system 22 to selectively advance and reverse a portion of tie ribbon 20 along the housing 14 for further manipulation by guide ring system 24 and twister/gripper head 26. Gear system 42 and pneumatic air cylinder system 48 work in cooperation to control twister/gripper head 26 for selectively twisting and gripping a portion of tie ribbon 20. Motor 46 drives both the gear assembly 42 and the drive roller system 40. PLC 44 is an electronic control system for controlling the timing and speed of operation of the various systems including tie manipulation system 22, drive roller system 40, gear assembly 42, air cylinder system 48 and guide ring system 24, as well as other components as will be further described.

PLC 44 is a programmable logic control system that is capable of storing and recalling for execution a sequence of commands to activate various devices electrically connected to PLC 44. A predetermined time delay between sequential events is selectively programmed into PLC 44 to control the relative timing of various events. PLC 44 is also capable of receiving electrical signals from various devices to provide a prompt or trigger for PLC 44 to cause activation of other devices either immediately or after a predetermined time delay. PLC 44 is preferably a KV series Model #KV-16T Programmable Logic Controller obtainable from Keyence Corporation of Osaka, Japan.

B. Tie Supply System

A lower portion of FIG. 3 further illustrates tie ribbon supply system 18. Tie supply system 18 provides a supply of tie ribbon 20 to the device housing 14 under tension to permit controlled and predictable manipulation of tie ribbon 20 from spool 60. System 18 includes spool 60, dancer arm 62, air cylinder 64 with extendable rod 66, and brake pad 68. System 18 further includes support arm 70, first roller 74, second roller 76, third roller 78, and sprag roller 80, as well as pitovable bracket 82 and guide pin 83.

Spool 60 holds a supply of continuous length of twist-tie ribbon fastener 20. Tie spool 60 is rotatably mounted relative to housing 14 and rotates in a first direction (shown by arrow A) to permit the tie ribbon 20 to be pulled off tie spool 60.

Rollers 74 and 78 are rotatably mounted on dancer arm 62 while roller 76 is rotatably mounted on housing 14. Rollers 74 and 78 rotate in a direction shown by the directional arrows to permit tie ribbon 20 to be pulled from spool 60. Sprag roller 80 rotates in a second direction (shown by the arrow B) while third roller 78 rotates in a third direction (shown by the arrow C). Sprag roller 82 is permitted to rotate only in the second direction (directional arrow B) but not to rotate in the opposite direction. This limitation prevents the tie ribbon 20 from slipping backward through tie supply system 18 toward spool 60. Bracket 82 permits selective control of the relative spacing between third roller 78 and sprag roller 80.

Dancer arm 62 is rotatably mounted on housing 14 about pivot 85 and is pivotally connected to end 86 of bracket arm 70. The position of dancer arm 62 relative to bracket 70 is selectively controlled by rod 66 of air cylinder system 64.

Air cylinder 64 is operated at a pressure and in a manner to cause the rod 66 to tend to extend outward from air cylinder 64 thereby causing the dancer arm 62 to be biased to pivot downward in a clockwise fashion. Since dancer arm 62 is pivotally connected to bracket 70 holding brake pad 68, this downward pressure exerted by air cylinder 64 causes brake pad 68 to be pressed against tie spool 60. This contact prevents tie ribbon 20 from being pulled off tie spool 60 and is considered a resting position of the tie spool 60 and dancer arm 62.

However, upon demand for tie ribbon 20 from tie manipulation system 22, tie supply system 18 permits release of tie ribbon 20 into tie manipulation system 22. Tie ribbon 20 is pulled from tie supply system 18 by drive roller system 40. Upon this pulling action, the tautness of tie ribbon 20 (extending from third roller 78 and sprag roller 80) lifts dancer arm 62 upward, causing dancer arm 62 to rotate upward and brake pad 68 to be moved away from tie spool 60. This permits tie ribbon 20 to be pulled off tie spool 60, around and through rollers 74,76,78, and 80 as well as about guide pin 83 for use in tie manipulation system 22.

Upon cessation of the pulling demand for tie ribbon 20 by drive roller system 40, air cylinder 64 causes dancer arm 62 to pivot downward to its resting position so that brake pad 68 is moved into contact with tie spool 60 for preventing unwanted release of tie ribbon 20 from tie spool 60. Accordingly, in operation, the rollers 74,76,78 and sprag roller 80 are relatively positioned in combination with tie spool 60 and dancer arm 62 so that selective control of movement of dancer arm 62 by air cylinder 64 and rod 66 maintains tautness on tie ribbon 20 within tie supply system 18 for controlled delivery to tie manipulation system 22.

C. Drive Roller and Tie Manipulation System

Figure 4:
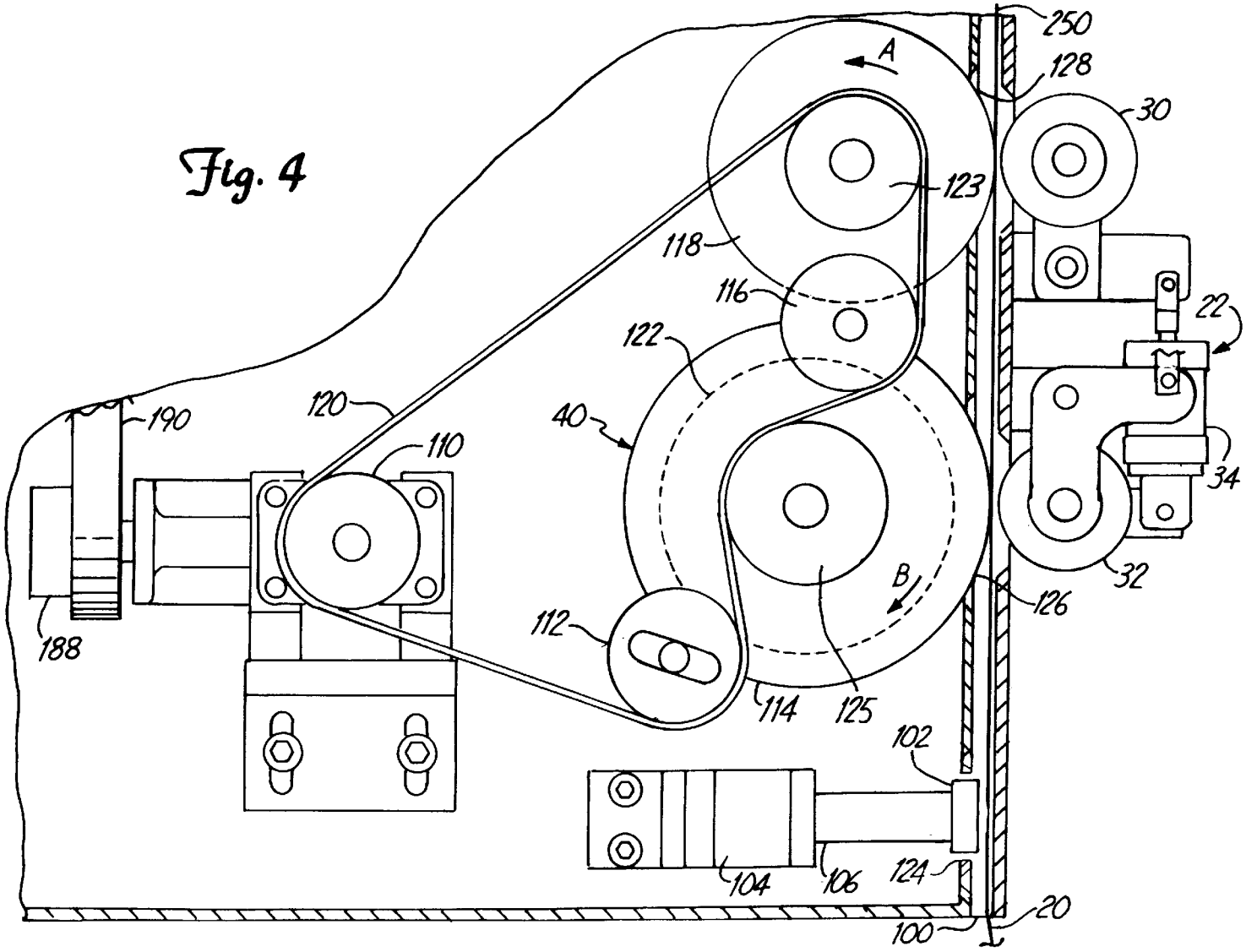
FIG. 4 is an enlarged side view of a positioning portion of twist-tie applicator of FIG. 3.

FIG. 4 is an enlarged side view of drive roller system 40 which acts as part of tie manipulation system 22 and which receives tie ribbon 20 from tie ribbon supply system 18. Tie manipulation system 22 includes primary feed roller 30, secondary feed roller 32, primary feed air cylinder actuator 34, and secondary feed air cylinder actuator 36 (see FIG. 1). As part of tie manipulation system 22, drive roller system 40 includes tie chute 100, brake disc 102, block and cylinder 104, and rod 106, as well as right angle gear box 110, moveable idler 112, secondary drive roller 114, fixed idler 116, primary drive roller 118, and belt 120. Primary drive roller 118 includes a power wheel 123 and secondary drive roller 114 includes a power wheel 125. A clutch 122 is cooperatively engaged with secondary drive roller 114.

Belt 120 extends about, and is powered by, gear box 110. Belt further extends about moveable idler 112, power wheel 125 of secondary drive roller 114 (coupled to clutch 122), fixed idler 116 and power wheel 123 of primary drive roller 118. Upon activation of gear box 110, belt 120 is moved into rotation about gear box 110 thereby causing belt 120 to cause continuous rotation of rollers 114 and 118 as well as idlers 112 and 116. Rotation of belt 120 causes primary drive roller 118 to rotate continuously in a counterclockwise rotation (shown by directional arrow A) and causes secondary drive roller 114 to rotate continuously in a clockwise rotation (shown by directional arrow B). Fixed idler 116 positions belt between primary drive roller 118 and secondary drive roller 114 while moveable idler 112 maintains tension on belt 120 and positions belt between secondary drive roller 114 and gear box 110. Moveable idler 112 is adjustable to control the amount of tension on drive belt 120 against power wheel 125 of secondary drive roller 114.

Tie manipulation system 22 further includes brake disc port 124, a secondary port 126 and primary port 128 formed along tie chute 100. Port 124 permits brake disc 102 to selectively extend into tie chute 100 for contacting and holding tie ribbon 20 in a fixed position relative to tie chute 100. Extension and retraction of brake disc 102 in and out of port 124 are controlled by extension and retraction of rod 106 relative to air cylinder 104 (which is controlled electronically by PLC 44). Primary port 128 and secondary port 126 permit primary drive roller 118 and secondary drive roller 114, respectively, to extend into tie chute 100 for contact with tie ribbon 20.

Primary feed roller 30 also extends into tie chute 100 for selective rolling contact with primary drive roller 118 and secondary feed roller 32 extends into tie chute 100 for selective rolling contact with secondary drive roller 114. Upon selective activation of primary feed roller actuator 34, primary feed roller 30 is moved into contact with primary drive roller 118 forcing tie ribbon 20 into contact between the two opposed rollers 118 and 30 (which define a nip in tie chute 100). Since primary drive roller 118 continuously rotates in a counterclockwise direction as shown by directional arrow A in FIG. 4, this rolling contact causes tie ribbon 20 to be advanced upward through tie chute 100 toward twister/gripper head 26 (FIG. 3).

Upon selective activation of secondary feed roller actuator 36 (see FIG. 1), secondary feed roller 32 is moved into contact with secondary drive roller 114 forcing tie ribbon 20 into contact between the two opposed rollers 114 and 32 (which define a nip in tie chute 100). Since secondary drive roller 114 continuously rotates in clockwise direction as shown by directional arrow B in FIG. 4, this rolling contact causes tie ribbon 20 to be advanced downward through tie chute 100 away from twister/gripper head 26 (FIG. 3). PLC 44 (FIG. 3) selectively controls activation and deactivation of primary feed roller 30 and secondary feed roller 32 (via air cylinder actuators 34 and 36) to alternatively move the tie ribbon either forwards toward or away from the twister/gripper head 26.

Primary feed roller actuator 34 and secondary feed roller actuator 36 are not required to be pneumatic air cylinders and can be any linear actuator capable of producing selective movement of feed rollers 30 and 32 into and out of contact with primary and secondary drive rollers 114 and 118.

Clutch 122 is a hysteresis clutch coupled to secondary drive roller 114 including power wheel 125 for causing the secondary drive roller 114 to act in either a rotating or non-rotating mode. Clutch 122 is configured and arranged relative to secondary drive roller 114 to selectively cause continuous rotation of secondary drive roller 114 and to selectively permit secondary drive roller 114 to slip relative to power wheel 125 so that secondary drive roller 114 does not rotate. Clutch 122 is selectively controllable, by mechanical adjustment of clutch 122, to cause slipping relative to secondary drive roller 114 upon a selectable, predetermined level of torque being exerted between the clutch 122 and secondary drive roller 114. This torque can be caused by tension on tie ribbon 20 as secondary drive roller 114 pulls tie ribbon 20 away from twister/gripper head 26, as will be described in more detail later. Right angle gear box 110 is powered by a pulley 188 and belt 190 connected to motor 46. Clutch 122 is preferably a PERMA-TORK brand hollow shaft clutch (Model HC/EC) obtainable from MAGPOWER® Magnetic Power Systems, Inc. of Fenton, Mo. Alternatively, clutch 122 is an electric clutch, known to those skilled in the art, that is also selectively controllable in the manner described above.

D. Guide Ring System

Figure 5:
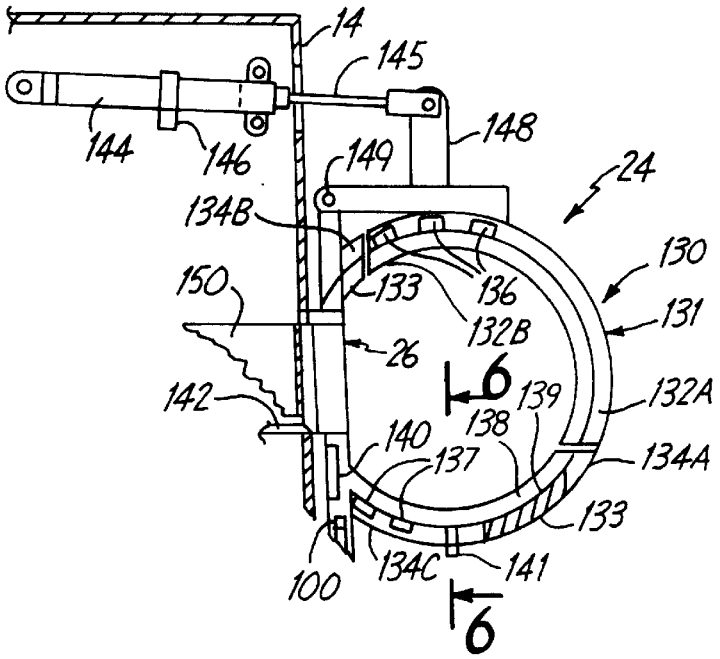
FIG. 5 is an enlarged side view of a tie-ring portion of twist-tie applicator of FIG. 3.
Figure 6:
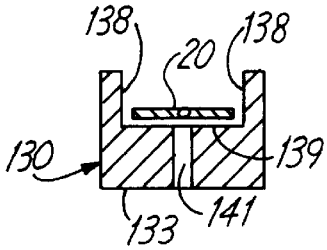
FIG. 6 is a sectional view of FIG. 5 taken along lines 6—6.

FIG. 5 is an enlarged side view of guide ring system 24 including guide ring 130, which has ring upper portion 131 including outer end 132A and inner end 132B, and ring lower portion 133 including outer end 134A, upper inner end 134B, and lower inner end 134C. The guide ring 130 has a first set of magnets 136 on upper portion 131, and a second set of magnets 137 on lower portion 133. Anvil 140, knife 142, and optic sensing mechanism 141 are associated with ring system 24. Ring system 24 further includes air cylinder 144 including rod 145, Hall effect switch 146, link 148 and pivot 149. As shown in FIG. 6, guide ring 130 includes side wall 138 and inner guiding surface 139.

As shown in FIG. 5, ring lower portion 133 is stationary and extends outward and away from housing 14. Air cylinder 144 is mounted within housing 14 so that rod 145 extends outwardly from housing 14 to pivotally support link 148. Air cylinder 144 is in communication with a pneumatic air supply system (not shown) and is controlled by and electrically connected to PLC 44. In addition, Hall effect switch 146 is operatively fastened about cylinder 144 and is electrically connected to PLC 44. Link 148 is connected to a top portion of ring upper portion 131 and is also pivotally connected to pivot base 149, which extends from housing 14. Upper magnets 136 and lower magnets 137 are embedded in ring portions 131 and 133 to be adjacent inner surface 139 of ring upper portion 131 and lower base portion 133, respectively. Magnets 136 and 137 are made from Neodymium and can be obtained from Magnetool in Troy, Mich. Sensing mechanism 141 is mounted within ring lower portion 133 to be exposed in inner surface 139 of ring 130. Sensing mechanism 141 is preferably a fiber optic sensing system capable of detecting an object passing the sensing mechanism 141 and sending a signal to PLC 44 to report the detection. Sensing mechanism 141 is preferably Model PBF 46U fiber optic and D12DAB6FP sensor obtained from Banner in Minneapolis, Minn.

Selective movement of rod 145 relative to air cylinder 144 is controlled by PLC 44 (FIG. 2). Retraction of rod 145 within air cylinder 144 causes link 148 and ring upper portion 131 to move upward away from lower base portion 133 as link 148 pivots about pivot base 149 (shown in FIG. 10). Extension of rod 145 relative to air cylinder 144 causes link 148 and ring upper portion 131 to move toward lower base portion 133 until outer end 132A of upper ring portion 131 contacts outer end 134A of lower base portion 133 and inner end 132B of upper ring portion 131 contacts upper inner end 134B of base portion 133. Although air cylinder 144 is preferred, air cylinder 144 can be replaced with a conventional high speed linear actuator, if necessary, sufficient to move upper ring portion 131 into and out of position against lower ring portion 133.

Hall effect switch 146 is configured and arranged as known in the art to magnetically sense sliding movement of rod 145 within cylinder 144. Upon Hall effect switch 146 sensing a predetermined, selective position of rod 145 relative to cylinder 144, Hall effect switch 146 sends a signal to PLC 44. Specifically, switch 146 is selectively positioned on cylinder 144 so that once ring 130 moves to and is in a closed position, the relative position of rod 145 causes switch 146 to send a signal to PLC 44, thereby activating an entire sequence of events manipulating tie ribbon 20 including activiation of primary feed roller 118 to engage tie ribbon 20 to cause advancement of tie ribbon 20 along tie chute 100.

When closed, ring 130 of ring system 24 provides a continuous annular surface through which article 38 (FIG. 2) can be placed and about which tie ribbon 20 moves in order to encircle article 38 with tie ribbon 20 prior to securely fastening a portion of tie ribbon 20 about article 38. As shown in FIG. 6, side walls 138 of ring 130 constrain and guide tie ribbon 20 for longitudinal sliding movement along inner surface 139 about ring 130.

As shown in FIG. 5, knife 142 is selectively movable along an axis parallel to a longitudinal axis of twister/gripper module 151 (FIGS. 5 and 7) to selectively extend across tie chute 100 (closely adjacent twister/gripper head 26) and past anvil 140 for cutting tie ribbon 20. Anvil 140 stabilizes tie ribbon 20 to facilitate cutting of tie ribbon 20. Extension and retraction of knife 142 is controlled by a pneumatic air cylinder (not shown), which is electrically connected to and activated by PLC 44.

E. Twister/Gripper Head Support System

Figure 7:
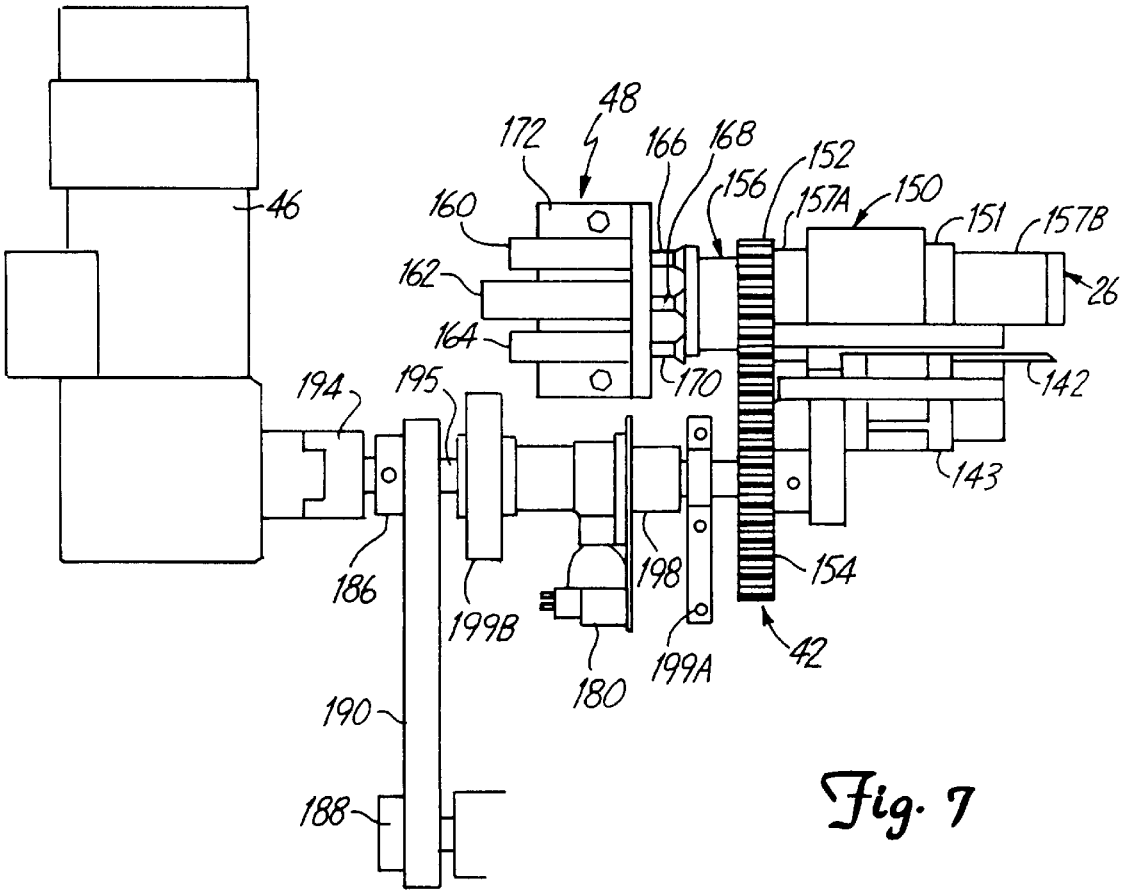
FIG. 7 is an enlarged side view of a tie-ribbon twisting and gripping portion of twist-tie applicator of FIG. 3.

FIG. 7 illustrates twister/gripper head support system 150 for performing the twisting and gripping functions of twister/gripper head 26. Twister/gripping head support system 150 includes twister/gripper head module 151, first spur gear 152 and second spur gear 154, and coupler 156. Module 151 also includes inner end 157A and outer end 157B. Support system 150 also includes air cylinder system 48 including first air cylinder 160, second air cylinder 162 and third air cylinder 164, which include first rod 166, second rod 168 and third rod 170, respectively. Frame 172 supports air cylinders 160, 162, and 164. Support system 150 also includes a high speed wrap spring clutch 180, first pulley 186, second pulley 188, and belt 190. Device 10 further includes coupling 194 and drive axle 195. Belt 190 transfers power from drive axle 195 and motor 46 at pulley 186 to pulley 188 for powering right angle gear box 110 (see FIG. 4) associated with drive roller system 40.

First spur gear 152 is mounted about an inner end 157A of twister/gripper module 151 and is operatively engaged with second spur gear 154, which is operatively mounted to drive axle 195 for selective rotation controlled by wrap spring clutch 180 via coupler 198. Wrap spring clutch 180 is mounted between brackets 199A and 199B to permit drive axle 195 to extend from motor coupling 194 through wrap spring clutch 180, and to second spur gear 154. Activation of wrap spring clutch 180 is controlled electronically by PLC 44. When activated by PLC 44, wrap spring clutch 180 selectively engages drive axle 195 for causing second spur gear 154 to rotate a predetermined number of revolutions (controlled by PLC 44), which in turn causes first spur gear 152 and twister/gripper module 151 to rotate a predetermined number of revolutions (e.g., 2,3,4, etc.). Wrap spring clutch 180 includes a mechanical adjustment to adjust the angular start and stop point at which wrap spring clutch 180 will engage drive axle 195. Rotation of twister/gripper module 151 causes rotation of twister/gripper head 26 for twisting the ends of a portion of tie ribbon 20 about each other to securely fasten the tie ribbon portion about article 38 extending within ring 130. Wrap spring clutch 180 is preferably a high speed revolution clutch sold as Model CB-6 from PSI, a division of Warner Electric of Pitman, N.J.

Air cylinder system 48 controls the gripping function of twisting/gripping module 151. Air cylinders 160, 162, and 164 are in communication with an air supply system (not shown) and are electronically connected to PLC 44 for controlling their activation and deactivation. Upon activation, each of first rod 166, second rod 168, and third rod 170 selectively extend a predetermined distance from or retract within air cylinders 160, 162, 164, respectively. Each of the rods 166, 168, 170 are maintained in contact with coupler 156 as will be described in further detail in FIGS. 8A–8C.

F. Twister/Gripper Head and Module

Figure 8A:
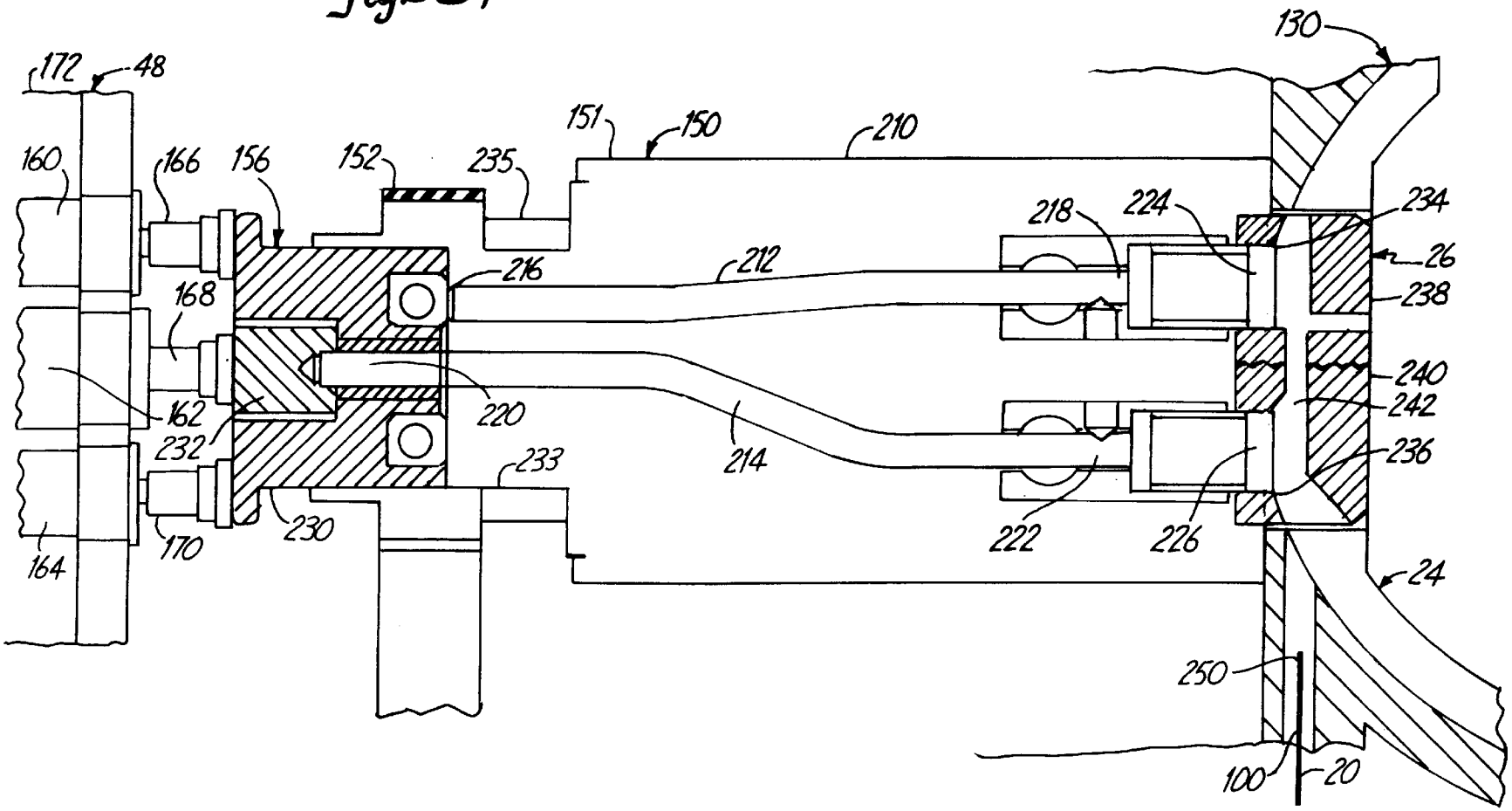
FIG. 8A is an enlarged sectional view of a twisting and gripping mechanism shown in FIG. 7.

As shown in FIG. 8A, twister/gripper module 151 includes housing 210, primary rod 212, and secondary rod 214. FIG. 8A shows module 151 and rods 212 and 214 rotated out of their resting orientation for clarity in illustration. A resting/orientation of module 151 and rods 212 and 214 will be shown in FIG. 9. As shown in FIG. 8A, primary rod 212 includes first end 216 and second end 218 while secondary rod 214 includes first end 220 and second end 222. Primary rod 212 also includes primary button 224 while secondary rod 214 includes secondary button 226. Coupler 156 includes outer cylinder 230 and inner cylinder 232. Housing 210 also includes a decreased outer diameter at its inner end 233 for being rotatably coupled within housing frame portion 235 to permit module 151 to rotate. Twister head 26 has a generally cylindrical shape (FIG. 9) and defines a first port 234 and a second port 236 as well as primary hood 238 and secondary hood 240 and passageway 242.

As shown in FIG. 8A, primary rod 212 has its first end 216 fixed to outer cylinder 230 of coupler 156 and its second end 218 fixed to primary button 224 with primary button 224 being supported in a slidably movable position within first port 234 of twister/gripper head 26. Secondary rod 214 has its first end 220 fixed to inner cylinder 232 of coupler 156 and its second end 222 fixed to secondary button 226 with secondary button 226 being supported in a slidably movable position within second port 236 of twister/gripper head 26. Primary rod 212 is generally straight while secondary rod 214 includes a curve at its midsection to allow sufficient spacing between primary button 224 and secondary button 226. Outer cylinder 230 of coupler 156 extends outwardly through module housing 210 to be in contact with rods 166 and 170 of air cylinder system 48. Inner cylinder 232 of coupler 156 is slidably movable relative to outer cylinder 230 and is in contact with rod 168 of air cylinder system 48.

As shown in FIG. 8A, primary button 224 and secondary button 226 are retracted within ports 234 and 236, respectively, to permit free passage of tie ribbon 20 through twister head 26 for advancement about ring 130.

Figure 8B:
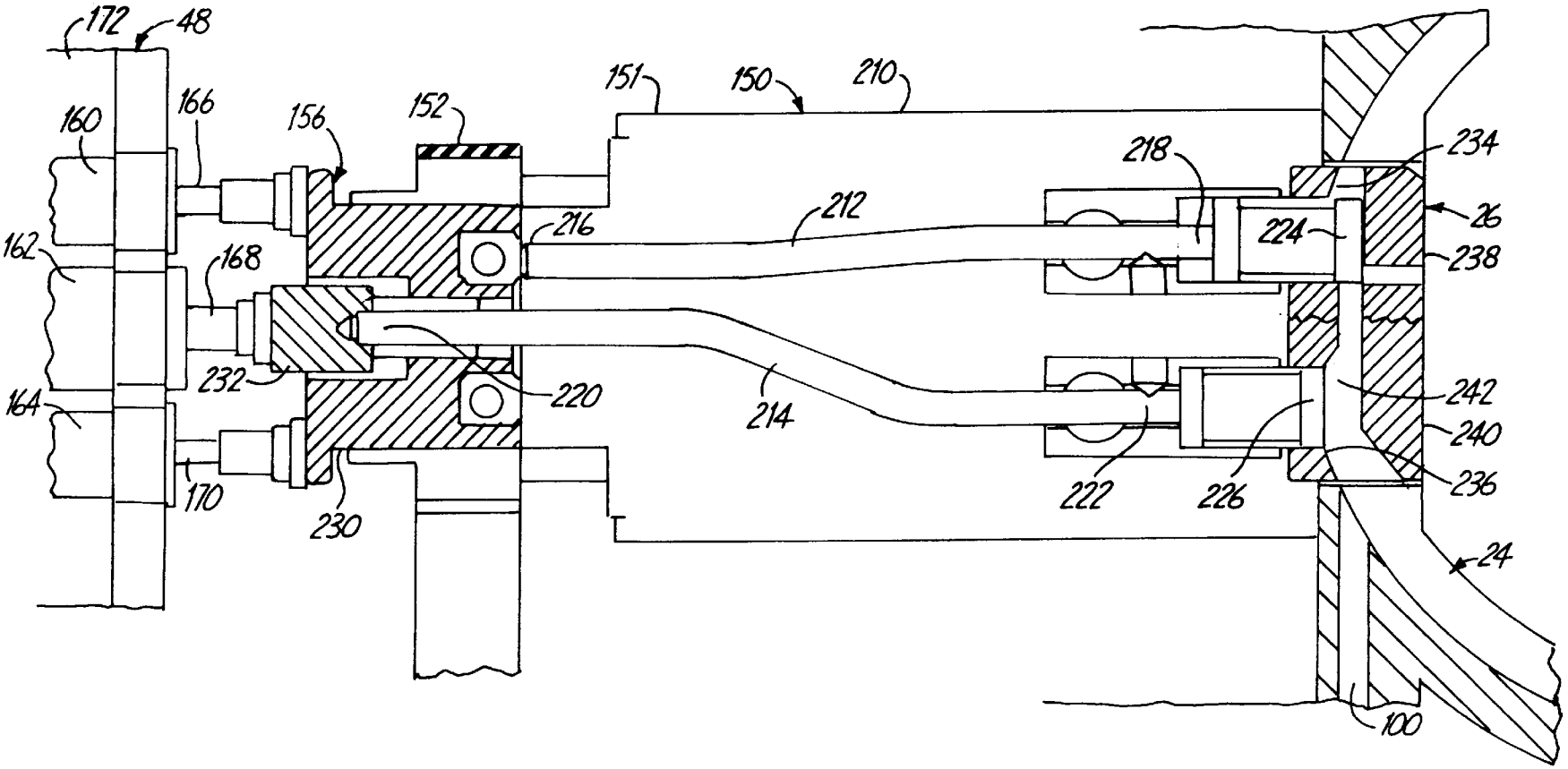
FIG. 8B is an enlarged sectional view of a twisting and gripping mechanism shown in FIG. 7.

As shown in FIG. 8B, upon activation of air cylinders 160 and 164 (via PLC 44), primary button 224 is extended into contact with primary hood 238 of twister head 26 through port 234. Specifically, activation of cylinders 160 and 164 causes rods 166 and 170 to extend outwardly, pushing outer cylinder 230 of coupler 156 a predetermined distance toward twister head 26 while inner cylinder 232 of coupler remains stationary. Via its connection at first end 216 to outer cylinder 230, primary rod 212 is also extended a predetermined distance thereby forcing primary button 224 into contact with primary hood 238. Air cylinders 160 and 164 are controlled (via PLC 44) to insure that rods 166 and 170 extend with sufficient force and distance so that primary rod 212 attempts to extend a small distance beyond hood 238 to insure positive gripping contact between button 224 and hood 238. When free end 250 of tie ribbon 20 extends within primary hood 238 of twister head 26, this extension of primary button 224 grips and locks free end 250 of tie ribbon 20 into position between primary button 224 and primary hood 238.

Figure 8C:
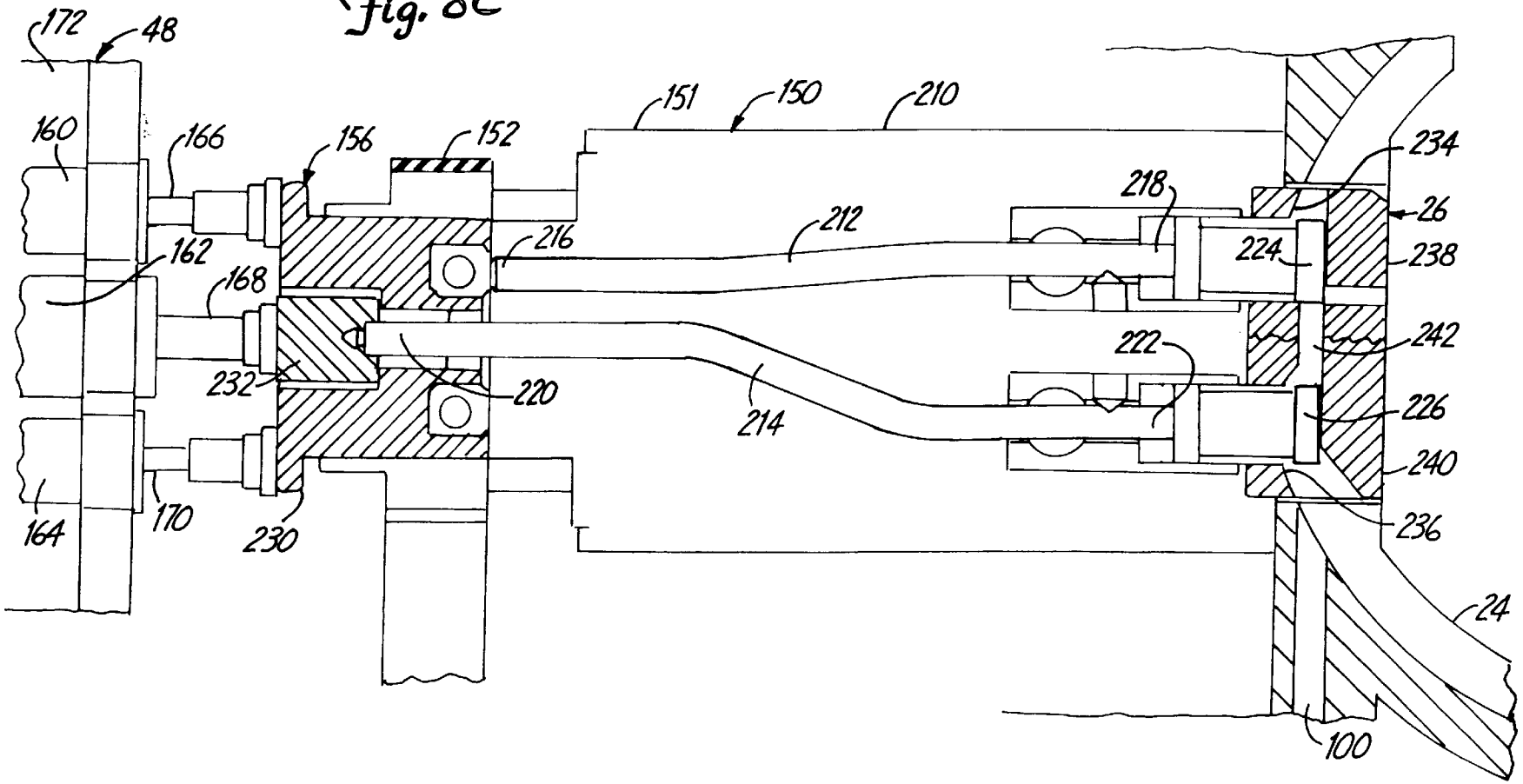
FIG. 8C is an enlarged sectional view of a twisting and gripping mechanism shown in FIG. 7.

As shown in FIG. 8C, upon selective activation of air cylinder 162 (via PLC 44), secondary button 226 is extended into contact with secondary hood 240 of twister head 26 through port 236. Specifically, activation of cylinder 162 causes rod 168 to extend outwardly, pushing inner cylinder 232 of coupler 156 a predetermined distance toward twister head 26. Via its connection at first end 220 to outer cylinder 230, secondary rod 214 is also extended a predetermined distance thereby forcing secondary button 226 into contact with secondary hood 240. When tie ribbon 20 extends within hood 240 of head 26, this extension of secondary button 226 grips and locks tie ribbon 20 into position between secondary button 224 and secondary hood 240. Similar to air cylinders 160 and 164, air cylinder 162 is controlled by PLC 44 to insure rod 168 extends a sufficient distance to insure positive gripping contact between button 226 and hood 240.

With both primary and secondary buttons 224 and 226 extended into contact with their respective primary hood 238 and secondary hood 240 of twister head (to accomplish the gripping function of twister/gripper head 26), the twisting function of twister/gripper module 151 and twister head 26 is accomplished by selectively rotating head 26 and module 151 a predetermined number of revolutions via activation of wrap spring clutch 180 by PLC 44. However, as shown in FIG. 5, tie ribbon 20 must be cut by knife 142 below secondary button 226 before the twisting function of head 26 and module 151 is initiated.

Figure 9:
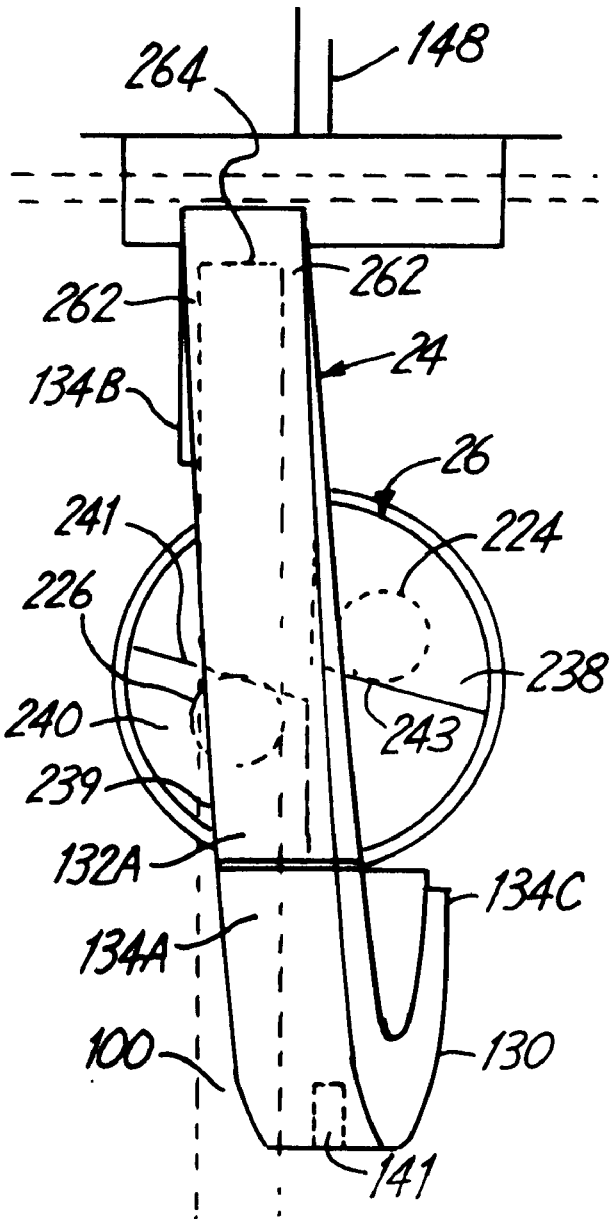
FIG. 9 is a plan view in elevation of a tie ring of the twist-tie applicator of FIG. 1.

FIG. 9 is a front elevational view of ring system 24 and twister head 26 as viewed from a front of device 10. As shown in FIG. 9, ring 130 is formed with a slight angle to align upper inner end 134B of lower ring portion 133 with tie chute 100, secondary button 226 and secondary hood 240, and to align lower inner end 134C of lower ring portion 133 with primary hood 238 and primary button 224. Primary button 224 and secondary button 226 have a generally circular transverse cross section and primary hood 238 and secondary hood 240 have a generally pie-shaped transverse cross-section. Primary button 224 and secondary button 226 are spaced from each other both horizontally and vertically. Twister head 26 also defines third port 239 for permitting passage of tie ribbon through a lower portion of secondary hood 240.

G. Operation of Device

Figure 10:
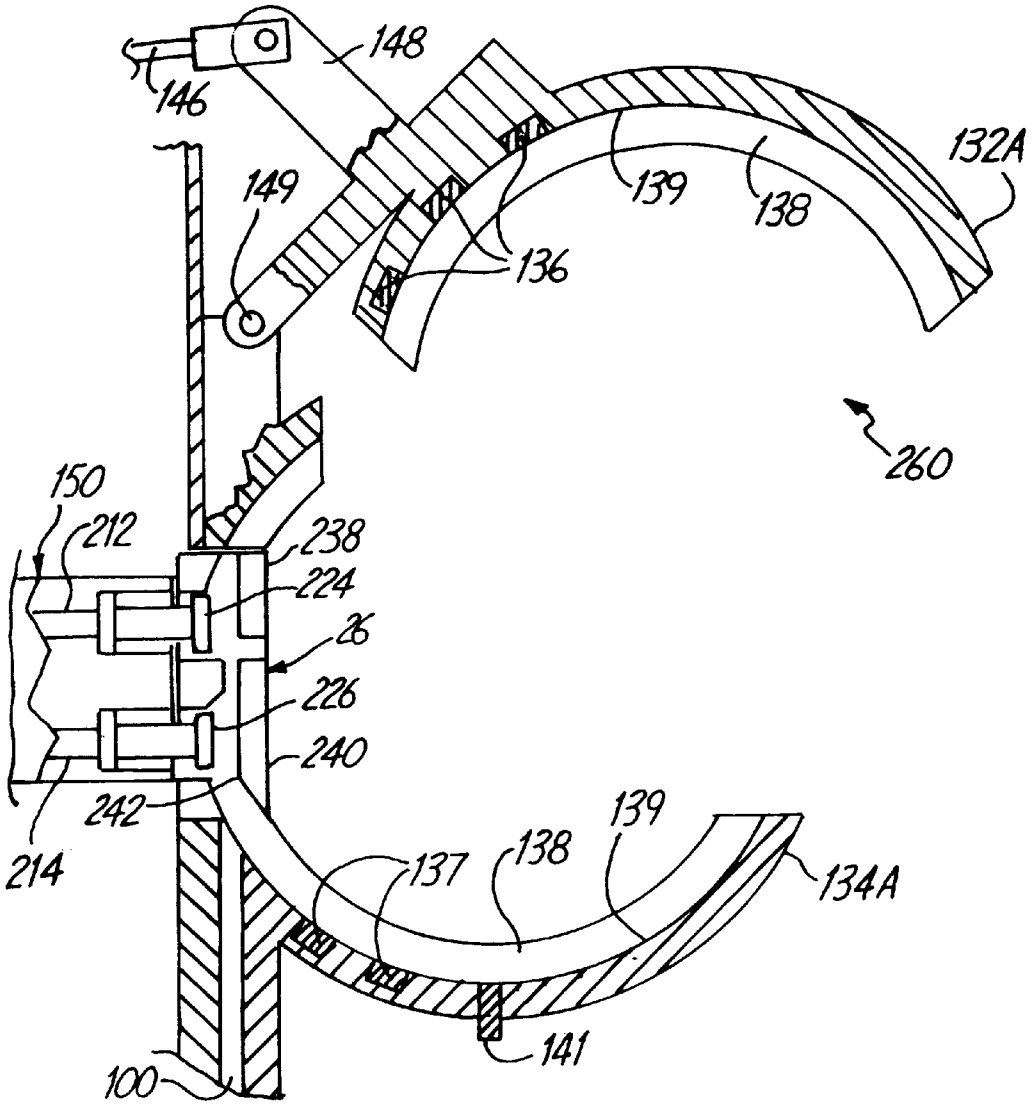
FIG. 10 is a sectional side view of tie-ring and twisting and gripping head of twist-tie applicator of FIG. 1 showing the guide ring in an open position.

FIG. 10 is a sectional view of ring system 24 and twister/gripper module 150 just prior to application of tie ribbon 20 about article 38 with device 10. FIG. 10 shows ring 130 of ring system 24 in an open mode, in which upper ring portion 131 is pivoted away from lower base portion 133 by activation of air cylinder 144 via PLC 44. This open position permits article 38 to be placed within the ring 130 through gap 260 created between ends 132A and 134A.

Prior to loading article 38 into ring 130, free end 250 of tie ribbon 20 is pre-loaded into position adjacent knife 142 (as will be further described later in association with FIG. 11). With tie ribbon 20 pre-loaded, primary buttons 224 and secondary buttons 226 are in a retracted position relative to twister/gripper head 26 (FIG. 8A). After placing article 38 within open ring 130, the ring 130 is moved it its closed position about the article (FIG. 5) and device 10 is activated either by a foot pedal or other initiation mechanism such as Hall effect switch 146 associated with closing ring 130.

Figure 11:
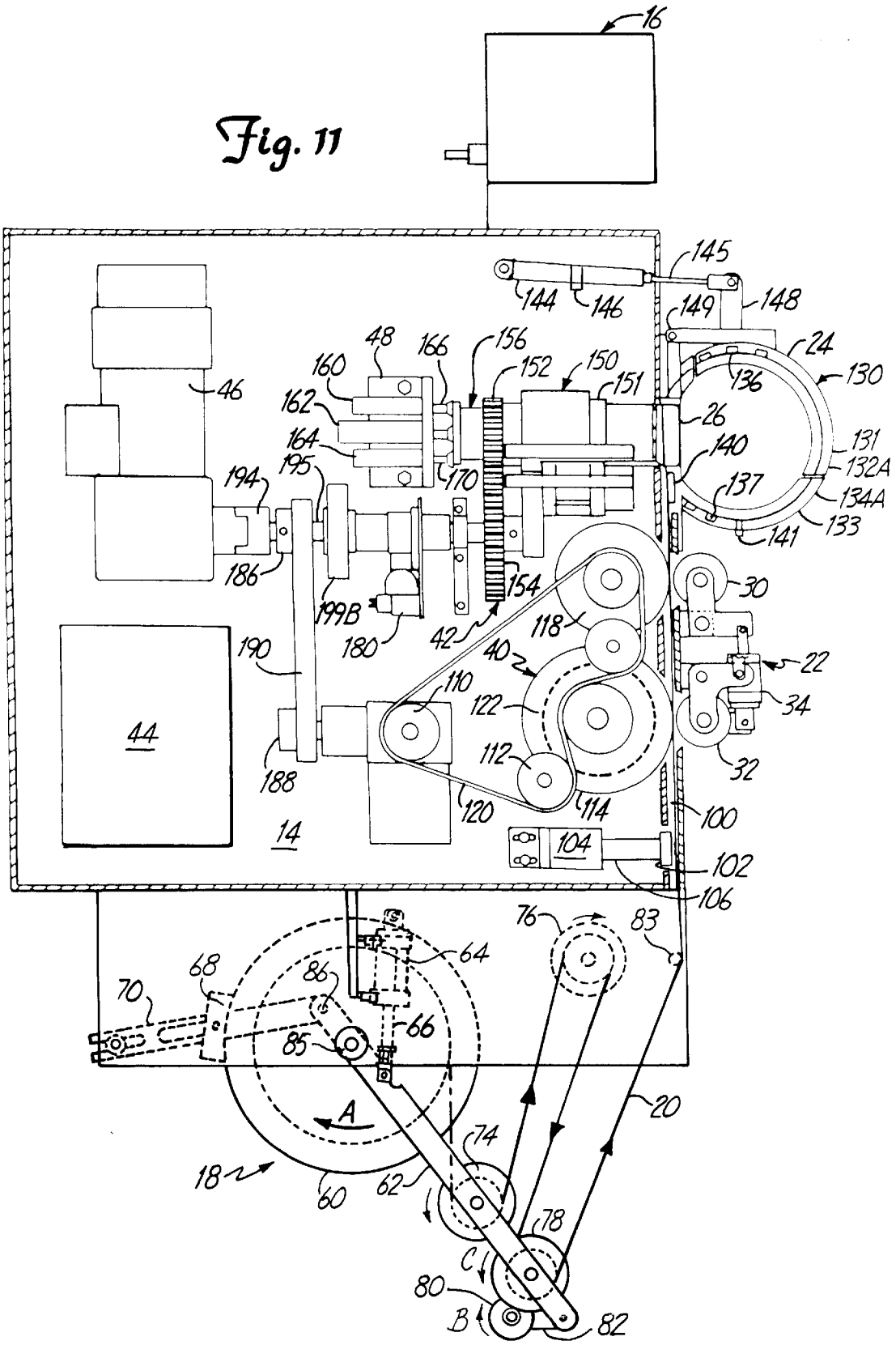
FIG. 11 is a sectional side view of the twist-tie applicator of FIG. 1.

FIG. 11 is a duplicate of FIG. 3 and is provided with reference numeral labeling for most elements of device 10 to facilitate describing device 10 in operation. Various other figures, including FIG. 9, will be used in association with FIG. 11 to describe movement of tie ribbon 20 throughout device 10 and about ring 130.

With tie ribbon 20 pre-loaded in housing 14, activation of device 10 causes feed roller 30 of tie manipulation system 22 to contact primary drive roller 118. This contact of rollers 30 and 118 advances tie ribbon 20 upwardly through tie chute 100 so that free end 250 of tie ribbon 20 moves past knife 142, through twister head 26 and around ring 130 so that tie ribbon 20 encircles article 38 within ring 130. Accordingly, the first major function of device 10 is to position tie ribbon 20 in ring 130 and twister head 26 about article 38.

As best seen in FIG. 9, movement of tie ribbon 20 about ring 130 and through twister head 26 includes the following events. First, free end 250 of tie ribbon 20 travels a path into port 239 of hood 240 and out of port 241 of hood 240, around inner surface 139 (see FIG. 6 or 10) of ring 130, and into port 243 of hood 238 until tie ribbon 20 stops leaving free end 250 of tie ribbon 20 over primary button 224 within primary hood 238.

During this travel path, as tie ribbon 20 first exits hood 240 of twister/gripper head 26 and begins to travel about ring 130, tie ribbon 20 is held tightly against ring inner surface 139 by magnets 136 which magnetically attract the metallic portion of tie ribbon. Of course, magnets 136 still permit longitudinal sliding movement of tie ribbon 20 along ring inner surface 139 but act to insure positioning of tie ribbon 20 adjacent to ring 130 during advancement of tie ribbon 20. As tie ribbon 20 travels further about ring 130, before re-entering twister head 26, free end 250 of tie ribbon 20 passes sensing mechanism 141 on ring 130, which sends a signal to PLC 44 to deactivate primary feed roller 30 from contact with primary drive roller 118 after a predetermined time delay programmed into PLC 44. This deactivation prevents further advancement of tie ribbon 20 along ring 130 and into twister head 26. The predetermined time delay is preferably selected so that advancement of tie ribbon 20 ends with free end 250 of tie ribbon over primary button 224. As free end 250 of tie ribbon 20 completes its travel path about ring 130, after passing sensing mechanism 141, magnets 137 magnetically attract tie ribbon against ring inner surface 139 to insure that tie ribbon 20 properly enters primary hood 238 of twister head 26.

With the tie ribbon 20 positioned about ring 130, the second major function of device 10 includes gripping free ends 250 and 251 of twist-tie 37 (i.e., cut portion of tie ribbon 20) and twisting them about each other with the twist-tie encircling article 38. To do so, PLC 44 triggers activation of air cylinder system 48 and twister/gripper module 151 to cause primary button 224 to extend into twister head 26 and grip free end 250 of tie ribbon 20 against primary hood 238 of twister head 26 (e.g., FIG. 8B). PLC 44 then activates secondary feed roller 32 to move into rolling contact with secondary drive roller 114. With free end 250 of tie ribbon 20 locked in place relative to twister head 26, clockwise movement of secondary drive roller 114 pulls the remaining tie ribbon 20 downward through tie chute 100 away from twister head 26, thereby pulling the tie ribbon 20 away from ring inner surface 139 to encircle article 38. Secondary drive roller 114 continues to pull tie ribbon 20 tightly about article 38 until a predetermined level of torque is measured between secondary drive roller 114 and clutch 122. Once this level of torque is met, corresponding to a predetermined tightness of tie ribbon 20 about article 38, then clutch 122 permits secondary drive roller 114 to slip relative to the clutch 122 to prevent secondary drive roller 114 from stretching tie ribbon 20. However, tie ribbon 20 remains taut to hold tie ribbon 20 closely about article 38 and to permit secondary button 226 to be advanced against secondary hood 240 to pinch tie ribbon 20 therebetween.

After tie retraction occurs, PLC 44 sends a signal to air cylinder 144 to cause ring 130 to move into an open position (see FIG. 10) in preparation for later insertion of another article in the next cycle. Ring 130 is opened by PLC 44 after a predetermined time delay from the initiation of the device (via Hall effect switch 146) upon the initial closing of ring 130.

With primary button 224 gripping free end 250 of tie ribbon 20 and secondary button 226 gripping the remaining portion of tie ribbon 20, knife 142 is activated to cut tie ribbon 20 below twister head 26 (see FIG. 11). This cut creates a second free end 251 of tie ribbon 20 that is gripped by secondary button 226. The remaining portion of tie ribbon 20 below knife 142 remains in its position held by drive roller system 40 and the remainder of tie manipulation system 22 for the next cycle. Specifically, just prior to knife 142 cutting tie ribbon 20, secondary feed roller 32 is deactivated, i.e., moved away from secondary drive roller 114, and brake disc 102 is activated (via cylinder 104 and PLC 44) to lock tie ribbon 20 in tie chute 100 in its standby mode until the next cycle starts.

With a cut portion of tie ribbon 20, which is now a twist-tie 37, encircling article 38, and with primary button 224 and secondary button 226 gripping free ends 250 and 251 of twist-tie 37, PLC 44 activates wrap spring clutch 180 to cause twister/gripper module 151 and twister head 26 to rotate a predetermined number of revolutions. This rotation causes free ends 250 and 251 of twist-tie 37 to be twisted about each other to securely fasten twist tie 37 about article 38 to achieve the result shown in FIG. 2. After twisting free ends 250 and 251 of twist-tie 37 a predetermined number of times, PLC 44 deactivates secondary button 226 and then primary button 224 to release free ends 250 and 251 of twist tie 37. Article 38, with twist-tie 37 secured thereabout as shown in FIG. 2, is then removed from the ring 130.

To begin the next cycle of securely fastening a twist-tie about an article, another article is inserted into the ring 130 which is already in the open position (see FIG. 10). However, alternatively, article 38 can be axially loaded into ring 130 for placement adjacent twister head 26 without opening ring 130. In this case, device 10 would be activated via foot pedal or an optical sensing mechanism detecting the presence of article 38 within ring 130.

H. Trouble Shooting, and Automatic and Selective Control Features

In addition to PLC 44 controlling the complete automatic sequence of events (e.g., cutting, gripping, twisting, etc.) to place twist-tie 37 about article 38, PLC 44 is programmed to perform a set of commands selectively in which each set of commands is commenced by activation of a single signal. For example, control button 16F is manipulated to place PLC 44 in a "JOG" mode and 16D is pressed to activate PLC 44 to cause the following events in sequence, one at a time. A separate single pressing of control button 16D is required to activate each step in the sequence and selectively causes the following events, one at a time: (1) free end 250 of tie ribbon 20 is advanced from tie chute 100 into and through twister head 26 and about ring 130 until tie ribbon free end 250 is positioned over primary button 224 within primary hood 238 of twister head 26; (2) gripping tie ribbon free end 250 between primary button 224 and primary hood 238 (by activating air cylinders 160,164 to cause primary rod 212 to extend primary button 224); (3) pulling tie ribbon 20 tightly about article 38 by activating secondary feed roller 32 to engage secondary drive roller 114 and move tie ribbon 20 through tie chute 100 away from twister head 26; (4) gripping tie ribbon 20 between secondary button 226 and secondary hood 240 (by activating air cylinder 162 to cause secondary rod 214 to extend secondary button 226); (5) cutting tie ribbon 20 with knife 142; (6) twisting free ends 250 and 251 of twist-tie 37 about each other to securely fasten twist-tie 37 about article 38 (by rotating twister/gripper module 151 and twister head 26); and (7) releasing free ends 250 and 251 of twist-tie 37 from twister/gripper head 26 (by retracting primary and secondary buttons 224 and 226).

This "JOG" feature allows activation of the functions of device 10 in a step by step manner to permit troubleshooting and evaluation of each of the components of device 10 in different stages of operation. Of course, PLC 44 can be programmed to activate additional steps or steps different than those listed above in the "JOG" troubleshooting mode.

A further example of the advantage of using PLC 44 to control activation and deactivation of the various systems of device 10 (to control the relative sequence and the relative sequence in timing of events caused by the systems) is the ability of device 10 to be used for specialized applications. For example, one variable or parameter that occurs in placing a twist-tie 37 about article 38 is controlling the number of times that the free ends 250 and 251 are twisted about each other. Commonly, only one or two twists of free ends 250 and 251 of a twist-tie 37 are made about an article 38. However, in some cases it is desirable to have as many as eight twists of free ends 250 and 251 about each other. For example, article 38 may have a varying diameter or outer circumference so that the portion of article 38 about which twist-tie 37 is applied must be maintained at a distance spaced from the face of twister head 26. For example, a portion of article 38 can be spaced as far as two inches away from the face of twist head 26. In that case, in order for twist-tie 37 to be securely fastened about article 38 and to enable twister head 26 to perform that function, the number of twists of ends 250 and 251 about each other needs to be increased substantially to make this application practical. With device 10 of the present invention, this adaptation can be readily achieved. PLC 44 can be further programmed to cause an additional number of revolutions of twister/gripper module 151 and twister head 26 (via spur gears 152 and 154) as controlled by wrap spring clutch 180. In prior devices, the number of revolutions of a twisting means is controlled by the shape and size of a rotating cam or rack and pinion system. Accordingly, in those prior devices, any adjustment made to the number of twists for the twist-tie about the article would require a mechanical adjustment of a cam or replacing a cam or part of the linkage system.

With device 10 of the present invention, the timing and sequence of many events can be readily changed. For example, device 10 of the present invention includes a sensing mechanism 141 built into ring 130 for detecting passage of free end 250 of tie ribbon 20 for causing selective activation and deactivation of drive roller system 40 and the remainder of tie manipulation system 22 after a predetermined time delay, as controlled by PLC 44. This predetermined time delay can be readily adjusted at PLC 44 to accommodate a different size ring 130 or adjust the degree to which free end 250 of tie ribbon 20 passes into twister head 26 before its advancement is stopped by drive roller system 40 and the remainder of tie manipulation system 22. Again, in prior devices, the stopping of advancement of the moving tie ribbon is controlled by the shape and/or size of a rotating cam and/or rack and pinion system or other complex linkage.

Moreover, none of these prior devices appear to have a control system that enables activation and deactivation of several events in sequence to permit adjustment and trouble shooting of the device. For example, the device 10 of the present invention permits moving the tie ribbon 20 through each function step by step whereas in the prior devices the shape and size of the various rotating cams and complex linkages, and their interconnection with drive roller systems, dictate the timing and sequence of their activation and deactivation. In particular, those devices are built in a manner which does not allow each of those functions to be readily performed in isolation as can be controlled by PLC 44 of the present invention.

The device 10 of the present invention also includes a magnetic holding and retracting means which facilitates and improves the ability of the tie ribbon 20 to track longitudinal sliding movement about ring 130 of the guiding ring system of the device. Specifically, as tie ribbon 20, including a metallic portion, first enters guide ring 130 a first set of magnets (e.g. magnets 136) pulls and holds tie ribbon 20 against an inner surface of the guide ring as tie ribbon 20 continues longitudinal sliding movement along the inner surface of the ring. In addition, a separate set of magnets (e.g. magnets 137) strategically positioned on an opposed portion of the ring 130, adjacent the entry point of the tie ribbon 20 into twister head 26, insures that tie ribbon 20 is in sliding contact with inner surface of guiding ring just prior to reentering twister head 26. This insures that the free end 250 of tie ribbon 20 will properly enter primary hood 238 of twister head 26.

In addition, air cylinder system 48, twister/gripper module 151 and twister/gripper head 26 are configured and arranged within housing 14 so that an extension of a rod from air cylinder system is simply and directly translated into extension of a push rod of module 151 for gripping an end of the twist-tie 37. In prior devices, a series of complex linkages, in which each linkage moves in a direction opposite to or at right angles to another linkage, are used to cause extension of a push rod for contact with a tie ribbon.

Finally, hysteresis clutch 122 provides a simple effective method for limiting the tension applied to tie ribbon 20 once it is tightly encircled about article 38. Moreover, high speed wrap spring clutch 180 provides a convenient solution for controlling the number of revolutions of twister/gripper module 151 and twister head 26.

Although the use of a metallic tie ribbon 20 is preferred to take advantage of magnets 136 and 138 in maintaining the tie ribbon along ring inner surface 264, the application of tie-ribbon 20 can also be performed a nonmetallic tie ribbon such as a tie ribbon made of a polymeric material.

I. Preloading the Tie Ribbon

The pre-loading of tie ribbon 20 into device 10 will now be described. Prior to placing article 38 in ring 130, tie ribbon 20 is fed into tie chute 100. Specifically, by initiating a "string-up" mode of control button 16F, brake disc 102 (see FIGS. 4 and 10) is moved to an open position to permit free end 250 of tie ribbon 20 to be fed from roller 80 of tie supply system 18 into and through tie chute 100. Tie ribbon 20 is then further manually pushed upward past secondary and primary drive rollers 114 and 118 until free end 250 of tie ribbon 20 is located just beyond knife 142, adjacent to or within secondary hood 240 of twister head 26. Next, brake disc 102 is again moved against tie ribbon 20 (by turning control button 16F to a "auto" mode) to hold tie ribbon 20 in a fixed position relative to tie chute 100. Manual cut button 16E is pressed on control panel 16 to cause knife 142 to cut tie ribbon 20 thereby removing the portion that extended upward beyond knife 142. With tie ribbon 20 trimmed, and its free end 250 located just below the twister head 26, device 10 is ready to begin a cycle of encircling and twisting a portion of the tie ribbon about an article extending within ring 130.

Although the present invention has been described with reference to preferred embodiments, workers skilled in the art will recognize that changes may be made in form and detail without departing from the spirit and scope of the invention.

What is claimed is:

1. A device for applying a twist-tie to a surface of an article, the device comprising:

a frame having a chute for guiding movement of a twist-tie ribbon;

means for extracting a continuous length of twist-tie ribbon from a supply of twist-tie ribbon;

means for positioning a portion of the continuous length of twist-tie ribbon about the surface of the article;

means for cutting the portion of the twist-tie ribbon from the continuous length of twist-tie ribbon; and means for gripping a first end of the twist-tie ribbon;

means for gripping a second end of the twist-tie ribbon;

means for automatically operating, independently and in any sequence, the positioning means, cutting means, first end gripping means, and second end gripping means.

2. The apparatus of claim 1 wherein the positioning means further comprises:

primary positioning means for selectively moving the tie fastener in a first direction.

3. The apparatus of claim 2 wherein the primary positioning means includes:

a primary drive roller disposed adjacent the chute wherein a first surface of the continuous length of twist-tie ribbon contacts the surface of the primary drive roller;

a primary feed roller positionable between an engaged position and a disengaged position, wherein in the engaged position, the primary feed roller is in contact with a second surface of the continuous length of twist-tie material and forces the tie ribbon into contact against the primary drive roller so that the primary drive roller moves the twist-tie ribbon in first direction toward the article, and wherein in the disengaged position, the primary feed roller is spaced from the primary drive roller and is not in contact with the continuous length of twist-tie material so that the primary drive roller does not move the twist-tie ribbon.

4. The apparatus of claim 3 wherein the positioning means further comprises:

secondary means for selectively moving the tie fastener in a second direction.

5. The application apparatus of claim 4 wherein the secondary positioning means includes:

a secondary drive roller disposed adjacent the chute and adjacent the primary drive roller so that the continuous length of twist-tie material passes over the secondary drive roller wherein the secondary drive roller continuously rotates;

a secondary feed roller positionable between an engaged position and a disengaged position;

wherein in the engaged position the secondary feed roller is in contact with the continuous twist-tie ribbon and forces the tie ribbon into contact against the secondary drive roller, causing the secondary feed roller and secondary drive roller to move the twist-tie ribbon in a second direction away from the article; and wherein in the disengaged position the secondary feed roller is spaced from the secondary drive roller and not in contact with the continuous length of twist-tie material.

6. The application apparatus of claim 5 wherein the secondary drive means further comprises:

a hysterisis clutch coupled to the secondary drive roller for selectively controlling rotation of the secondary drive roller wherein the clutch is configured and arranged to engage the secondary drive roller and cause continuous rotation of the secondary drive roller and wherein, upon the secondary drive roller experiencing a predetermined level of torque created by tension of the tie fastener against the secondary drive roller, the clutch permits slipping between the secondary drive roller and the clutch to prevent rotation of the secondary drive roller to maintain the tension of the tie fastener against the secondary drive roller at a predetermined level.

7. The device of claim 1 wherein the gripping and twisting means further includes:

a general circular shaped head adjacent the chute and aligned along a travel path of the continuous length of tie ribbon, the head including a first bore and a second bore extending parallel to each other with a first end of the first and second bore being exposed adjacent the ring and tie ribbon travel path;

a first elongate push rod extending through the first bore and a second elongate push rod extending through the second bore, the first push rod having a first end exposed to the ring and the tie ribbon travel path for gripping an end of the tie ribbon and having a second end, the second push rod having a first end exposed to the ring and the tie ribbon travel path for gripping an end of the tie ribbon and having a second end;

a cylindrically shaped coupler having an inner cylinder and an outer cylinder wherein the inner and outer cylinder are selectively slidably movable relative to and independent of each other and are capable of being rotated together in unison, the outer cylinder having a first end connected to the second end of the first push rod and having a second end, and the inner cylinder having a first end connected to the second end of the second push rod and having a second end;

an air cylinder system including a first air pressure cylinder having a chamber and a first rod selectively extendable from the chamber and a second air pressure cylinder having a chamber a second rod selectively extendable from the chamber, wherein the first end of the first cylinder rod is directly connected to the inner cylinder of the coupler and the first end of the second cylinder rod is directly connected to the outer cylinder of the coupler; and wherein the selective extension of the first air cylinder rod causes sliding movement of the inner cylinder of the coupler to cause the second push rod to be moved through the first bore of the head to expose the first end of the second push rod beyond the first bore for gripping an end of the tie ribbon and selective extension of the second air cylinder rod causes sliding movement of the outer cylinder of the coupler to cause the first push rod to be moved through the second bore of the head to expose the first end of the first push rod beyond the second bore for gripping an end of the tie ribbon.

8. The device of claim 1 wherein the gripping and twisting means further includes:

an elongate push rod having a first end and a second end and being arranged relative to the ring so that the first end is adjacent the tie ribbon travel path of the ring for gripping the end of the tie ribbon and being capable of sliding movement towards and away from the tie ribbon;

a coupler having a first end and a second end and a generally cylindrical shape with the first end of the coupler connected to the second end of the first push rod, the coupler being capable of selective sliding movement along a path generally parallel to a longitudinal axis of the push rod; and an air pressure cylinder and rod system including an extendable rod directly connected to the second end of the coupler so that selective sliding movement of the rod relative to the cylinder causes sliding movement of the coupler and of the push rod, the extendable rod being generally parallel to a longitudinal axis of the push rod and coupler.

9. The device of claim 8 wherein the extendable rod of the cylinder and rod system extends in the same direction as push rods extend and retracts in the same direction as the push rods retract.

10. A device for applying a twist-tie to a surface of an article, the device comprising:

a frame having a chute for guiding movement of a twist-tie ribbon;

means for extracting a continuous length of twist-tie ribbon from a supply of twist-tie ribbon;

means for positioning a portion of the continuous length of twist-tie ribbon about the surface of the article;

means for cutting the portion of the twist-tie ribbon from the continuous length of twist-tie ribbon; and means for gripping the ends of the twist-tie;

means for twisting the ends of the twist-tie about the surface of the article while gripping the ends of the twist-tie; and means for automatically and selectively controlling a programmable sequence of activation and deactivation of the extracting means, positioning means, gripping means, cutting means and twisting means to position the twist-tie about the article, cut a portion of the ribbon, and twist the tie tightly about the article, wherein the combination of operations can be altered to include any sequence of activation and deactivation.

11. The device of claim 10 wherein the controlling means further comprises:

means for selectively interrupting the programmable sequence of activating and deactivating the positioning means, cutting means, gripping means, and twisting means to permit the activation and deactivation of each of the positioning means, cutting means, gripping means and twisting means in isolation relative to each of the other means.

12. The device of claim 10 wherein the controlling means is further capable of selectively controlling the number of revolutions of the twisting means.

13. The apparatus of claim 1, wherein the positioning means further comprises:

means for sensing a position of the tie fastener about the article wherein the positioning means is selectively activated upon the sensing means sensing movement of the twist-tie adjacent the sensing means.

14. The apparatus of claim 10, wherein the positioning means further comprises:

means for sensing a position of the tie fastener about the article wherein the positioning means is selectively activated upon the sensing means sensing movement of the twist-tie adjacent the sensing means.

15. The apparatus of claim 3 wherein the primary positioning means further comprises:

a primary feed air pressure cylinder having a first chamber and a first link selectively extendable from the first chamber, wherein an end of the first link is directly connected to the primary feed roller; and wherein the selective extension of the link causes the primary feed roller to move into an engaged position.

16. The apparatus of claim 5 wherein the secondary positioning means further comprises:

a secondary feed air pressure cylinder having a second chamber and a second link selectively extendable from the second chamber, wherein an end of the second link is directly connected to the secondary feed roller; and wherein the selective extension of the link causes the primary feed roller to move into an engaged position.

17. A device for positioning a tie fastener about an article and for fastening the tie fastener, the device comprising:

a tie fastener guide having an annular inner surface configured and arranged to receive and guide the sliding movement of the tie fastener along the inner surface and being sized to permit insertion of the article within the guide without contacting the guide;

means for moving the tie fastener along an inner surface of the guide so that the tie fastener is capable of forming a loop about the article;

means for detecting a first end of the tie fastener moving past a detecting means, the detecting means being located along the guide and exposed to the path of movement of the tie fastener, and wherein, upon the detecting means detecting the first end of the tie fastener, the moving means is selectively actuated after a programmed time delay to stop movement of the tie fastener along the inner surface of the guide;

means for separately clamping the first end and the second end of the tie fastener so as to form a loop about the article, and wherein, the clamping of the first end and the second end of the tie fastener are actuated independently from each other;

means for cutting the tie fastener;

wherein, the cutting means is operated independently from any other means, and may occur before or after actuation of the clamping means;

means located adjacent the clamping means along the guide for rotating the first and second ends of the tie fastener about each other, while held by the clamping means, to tighten a loop of the tie fastener about the article;

wherein, the rotating means is operated independently from the positioning means, clamping means and cutting means, and may be programmed to rotate a predetermined number of times.

* * * * *

UNITED STATES PATENT AND TRADEMARK OFFICE

CERTIFICATE OF CORRECTION

PATENT NO. : 5,916,108

DATED : JUNE 29, 1999

INVENTOR(S) : STAN W. DRIETZ ET AL.

It is certified that error appears in the above-identified patent and that said Letters Patent is hereby corrected as shown below:

On the title page: Item [54] and Column 1, line 2,

The Title, delete "ARITCLE", insert --ARTICLE--

Col. 16, line 28, delete "general", insert --generally--

Signed and Sealed this

First Day of February, 2000

*Attest:*

Q. TODD DICKINSON

*Attesting Officer*

*Acting Commissioner of Patents and Trademarks*